United States Patent [19]

Ueno

[11] Patent Number: 4,956,529

[45] Date of Patent: Sep. 11, 1990

[54] COMPACT SWITCH DEVICE

[75] Inventor: Hiroshi Ueno, Aichi, Japan

[73] Assignee: Kabushiki Kaisha Tokai Rika Denki Seisakusho, Aichi, Japan

[21] Appl. No.: 301,303

[22] Filed: Jan. 25, 1989

[30] Foreign Application Priority Data

Feb. 8, 1988 [JP] Japan ..... 63-15296[U]

[51] Int. Cl.[5] ..... H01H 3/42

[52] U.S. Cl. ..... 200/524; 200/523

[58] Field of Search ..... 200/523, 524, 525, 533

[56] References Cited

U.S. PATENT DOCUMENTS

| | | | |
|---|---|---|---|
| 3,582,592 | 6/1971 | Schadow | 200/524 |
| 3,914,570 | 10/1975 | Lockard | 200/524 |
| 4,531,026 | 7/1985 | Terajima et al. | 200/524 |
| 4,670,629 | 6/1987 | VanBenthuysen et al. | 200/524 |
| 4,677,267 | 6/1987 | Oba | 200/524 |

*Primary Examiner*—Henry J. Recla
*Assistant Examiner*—Glenn T. Barrett
*Attorney, Agent, or Firm*—Finnegan, Henderson, Farabow, Garrett, and Dunner

[57] ABSTRACT

A compact switch device of the present invention includes a casing having a depressible operating member mounted thereon for slidable movement between an inoperative and an operative position. A switch is mounted on the casing and opens and closes in response to the movement of the operating member. The switch device is spring biased to the inoperative position. A cam is mounted on either the casing or the operating member. A locking pin is mounted on the casing or the operating member not already supporting the cam. A closed loop cam groove includes a retaining portion of a generally V-shape and a convex guide portion spaced from and opposite to the retaining portion. The distal end of the lock pin is engageable in the retaining portion to hold the operating member in the operative position. A holder spring is provided to bias the distal end of the lock pin into the cam groove and to urge the distal end toward the retaining portion when the distal end of the lock pin is situated between the retaining portion and the convex guide portion.

4 Claims, 4 Drawing Sheets

COMPACT SWITCH DEVICE

FIELD OF THE INVENTION

The present invention relates to a compact switch device including a push button switch that may be alternately opened and closed by depressing an operating member.

BACKGROUND OF THE INVENTION

One conventional switch device includes an operating member mounted on a casing for movement along the casing. A switch means is provided and may be opened or closed in response to the movement of the operating member when it is depressed. A return spring is provided for biasing the operating member in the inoperative, or initial, position. A cam groove having a generally heart-shaped loop is formed in either the operating member or the casing. A lock member formed from a torsion coil spring is mounted at one end of the operating member or casing whichever does not support the cam groove. The free end of the torsion coil spring is received in the cam groove for movement along the groove.

Typically, when the operating member of such a conventional switch device is depressed, the free end of the torsion coil spring is moved and secured into a retaining portion of the cam groove in locked engagement. Thus, the operating member is held in the operative position when the switch means is in the closed, or activated, condition. When the operating member is subsequently depressed, the free end of the lock member is released from locked engagement with the retaining portion of the cam groove. As a result, the operating member is returned to the inoperative, or initial, position subject to the bias force of the return spring.

It has become popular to fabricate conventional switch devices in a compact construction. Accordingly, a compact lock means is desired having a cam groove and a lock member. However, the presence of the torsion coil spring lock member of the conventional design has rendered the achievement of a compact lock means impossible.

In an effort to solve this difficulty, a generally U-shaped wire has been used as a lock member, or pin, wherein one end of the lock pin may move along the cam groove. This arrangement, however, is not sufficient because one end of the lock pin often extends past the retaining portion of the cam groove thereby avoiding successful capture in the retaining portion of the cam groove. The lock pin utilized by the present invention allows for the compact manufacture of a quality switch device having improved positioning precision.

SUMMARY OF THE INVENTION

An object of the present invention is to overcome the problems and disadvantages of the prior art.

An object of the present invention is a compact switch device.

Another object of the present invention is a switch device capable of selectively ensuring complete securement of the lock pin in the retaining portion of the cam groove.

To achieve the objects and in accordance with the purpose of the present invention, as embodied and broadly described herein, the present invention comprises a compact switch device including a casing, an operating member depressibly mounted on the casing for movement within the casing between an inoperative and an operative position, a return spring cooperating with an operating member to urge the operation member to the inoperative position, a cam means mounted on either the casing or the operating member and having a cam groove with a closed loop configuration for retaining a portion with a generally V-shape and a convex guide portion spaced a distance from and opposite of the retaining portion, and a lock pin mounted at one end on the casing or the operating member not already supporting the cam means and at the other end in the cam groove for movement in response to the depression of the operating member along the cam groove. The other end of the lock pin is fixedly engaged in the retaining portion to hold the operating member in the operative position. The other end of the lock pin is guided by the convex guide portion toward the retaining portion. A holder spring biases the other end of the lock pin in the cam groove and urges the end of the lock pin toward the retaining portion when the other end of the lock pin is disposed between the retaining portion and the convex guide portion. Finally, a switch means is mounted on the casing and opens and closes in response to the movement of the generating member.

BRIEF DESCRIPTION OF THE DRAWINGS

The accompanying drawings, which are incorporated in and constitute a part of this specification, illustrate several embodiments of the present invention and together with the description, serve to explain the principles of the present invention.

DETAILED DESCRIPTION OF THE PREFERRED EMBODIMENTS

Figure 2:
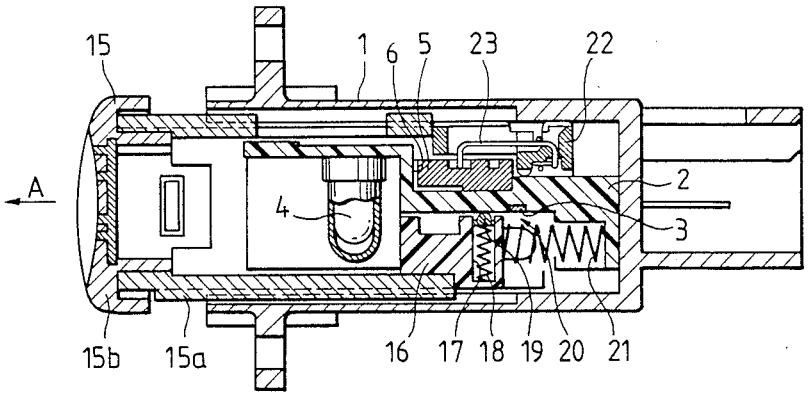
FIG. 2 is a cross-sectional view of an embodiment of the switch device of the present invention in the inoperative position.
Figure 3:
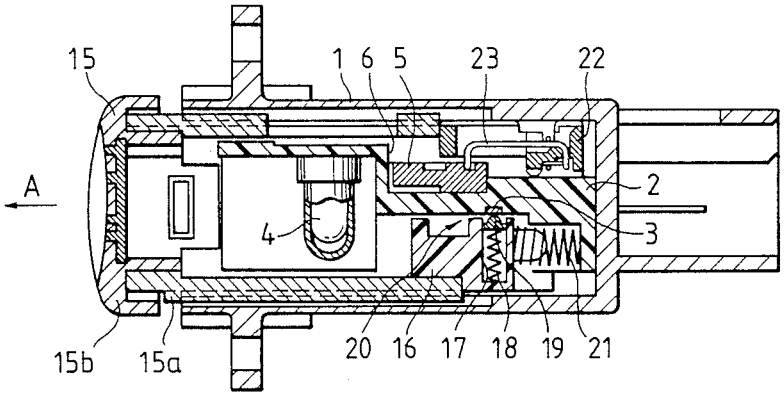
FIG. 3 is a cross-sectional view of the switch device of an embodiment of the present invention in the operative position.

As shown in FIGS. 2 and 3, the switch device of the present invention comprises a hollow elongated casing 1 having an open end and a closed end. An insulating member 2 is fixedly mounted on the bottom wall of the casing 1 in the area of the closed end. The insulating member 2 is shaped such that it is stepped intermediate its two opposing ends. A plurality of stationary electrical contacts 3 and a lamp 4 are mounted on the first of the two sides of the insulating member 2. A recess is formed in the second side of the insulating member 2. A lock plate 5 is fixedly mounted in the recess and located intermediate the two ends of the insulating member.

Figure 4:
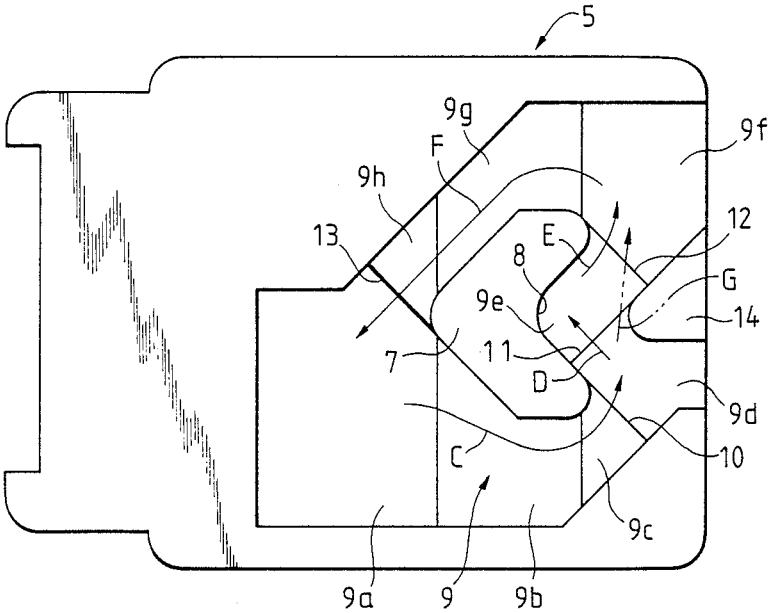
FIG. 4 is an enlarged top plan view of the lock plate including a cam groove of an embodiment of the present invention.

As shown in FIG. 4, the lock plate 5 has a cam groove 9 formed on the face of the lock plate 5 facing away from the insulating member 2. The cam groove 9 extends around a generally heart-shaped land 7 that is located in the center of the lock plate 5. Cam groove 9 is in the form of a generally heart-shaped loop corresponding in contour to the heart-shaped land 7. The cam groove 9 has a retaining portion 8 of a generally V-shape. Further, a convex guide portion 14 is located in opposed spaced relation to the retaining portion 8.

Figure 5:
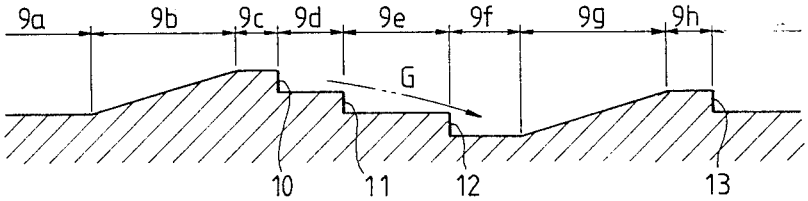
FIG. 5 is a side, view of the bottom surface of the cm groove of an embodiment of the present invention.

FIG. 5 illustrates the bottom surface of the cam groove 9 represented in terms of sequential movement. Specifically, the bottom surface of the cam groove 9 is composed of a total of eight surfaces, namely, surfaces 9*a*, 9*b*, 9*c*, 9*d*, 9*e*, 9*f*, 9*g* and 9*h* arranged as recited in a counterclockwise direction. The second and seventh surfaces 9*b* and 9*g* are inclined. The remainder of the surfaces are flat. A stepped portion 10 is provided at the junction between the third and fourth surfaces 9*c* and 9*d*. A stepped portion 11 is located at a junction between the fourth and fifth surfaces 9*d* and 9*e*. A stepped portion 12 is provided at the junction between the fifth and sixth surfaces 9*e* and 9*f*. Finally, a stepped portion 13 is positioned at the junction between the eighth and first surfaces 9*h* and 9*a*.

As shown in FIGS. 2 and 3, an operating member 15 is mounted on the casing 1 and may slide therealong. Specifically, the operating member 15 includes a tubular body portion 15*a* inserted into the casing 1 and a generally cap-shaped push button portion 15*b*. The push button 15*b* is attached to the outer end of the body 15*a* and is disposed exteriorly of the open end of the casing 1. A contact holder 16 is fixedly secured to the inner end of the operating member 15 for movement within the casing 1. A compression coil spring 18 is mounted within a mounting hole 17 formed in the contact holder 16. An electrical contact 19 is movably disposed in the mounting hole 17 and is urged toward the insulating member 2 by the compression coil spring 18. The movable electrical contact 19 and the stationary electrical contacts 3 constitute a switch 20.

A return spring 21 is formed from a compression coil spring and functions between the contact holder 16 and the insulating member 2 to urge the operating member 15 toward the inoperative or initial position. That is, the compression coil spring 21 operates on the contact holder 16 in the direction indicated by arrow A. A lock pin holder 22 is fixedly secured to the inner end of the operating member 15 for movement therewith. Specifically, the lock pin holder 22 is disposed on the side of the insulating member 2 facing away from the contact holder 16. Further, the lock pin holder 22 is configured to have a generally rectangular frame and is positioned a spaced distance from the lock plate 5.

Figure 1:
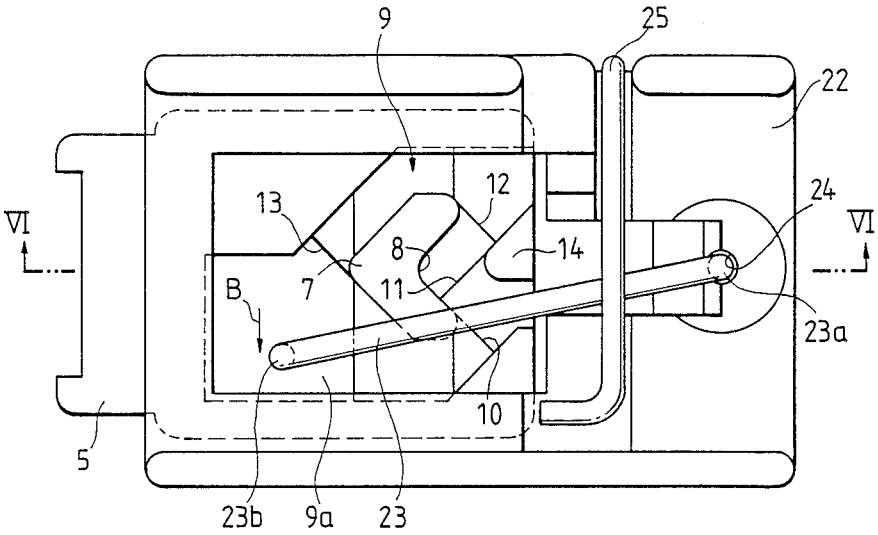
FIG. 1 is a top plan, view of a portion of the switch device of an embodiment of the present invention.
Figure 6:
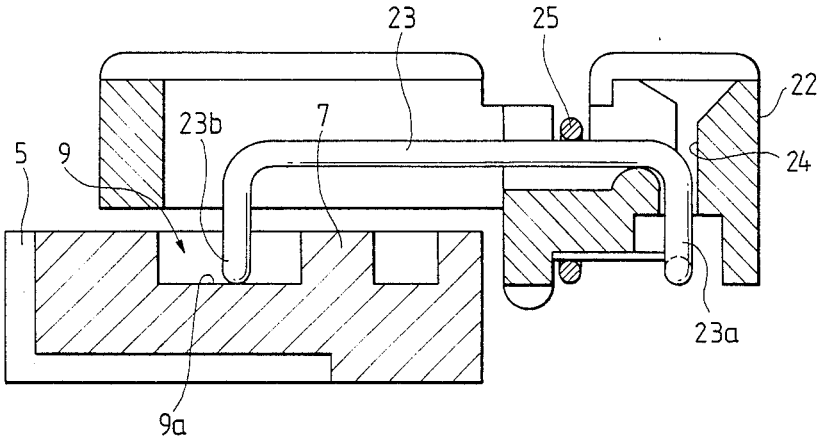
FIG. 6 is a cross-sectional view taken along the line VI—VI of FIG. 1.

A lock pin 23 is made of a metal wire having opposite ends bent at right angles so that the lock pin 23 assumes a generally U-shape. The lock pin 23 cooperates with the cam groove 9 to function as a lock means. As shown in FIGS. 1 and 6, the proximal end 23*a* of the lock pin 23 is fitted in a hole 24 formed in the lock pin holder 22 so that the lock pin 23 is pivotallY or angularly movable about the proximal end 23*a*. The distal end 23*b* of the lock pin 23 is received in the cam groove 9 formed in the lock plate 5.

A holder spring 25, formed of a generally U-shaped metal wire defined by a pair of legs, is fitted on the lock pin holder 22. That is, one leg of the holder spring 25 is resiliently held against the straight portion of the lock pin 23 forming the major portion of lock pin 23 that extends between the bent opposite ends or the proximal end 23*a* and the distal end 23*b*, so that the distal end 23*b* is urged into the cam groove 9. The holder spring 25 is arranged so that a segment of the force exterted by the holder spring 25 urges the distal end 23*b* in the direction indicated by arrow B shown in FIG. 1.

As shown in FIG. 2, when the operating member 15 is in the initial or inoperative position the movable electrical contact 19 is positioned apart from the stationary electrical contacts 3. As a result, the switch 20 remains in the open or deactivated condition.

As shown in FIGS. 1 and 6, the distal end 23*b* of the lock pin 23 received in the cam groove 9 is disposed in contact with the first surface 9*a* of the cam groove 9. Subsequently, if the operating member 15 is depressed in the direction opposite to arrow A against the bias of the return spring 21, the lock pin holder 22 and hence the lock pin 23 are moved together with the operating member 15 in the same direction. At this point, the lock pin 23 is angularly moved about its proximal end 23*a*, so that its distal end 23*b* is moved from the first surface 9*a* to the fourth surface 9*d*. Precisely, the distal end 23*b* follows the contour sequence of the cam groove, namely, the first, second and third surfaces 9*a* , 9*b* and 9*c* and the stepped portion 10. This path is depicted by arrow C in FIG. 4.

Figure 7:
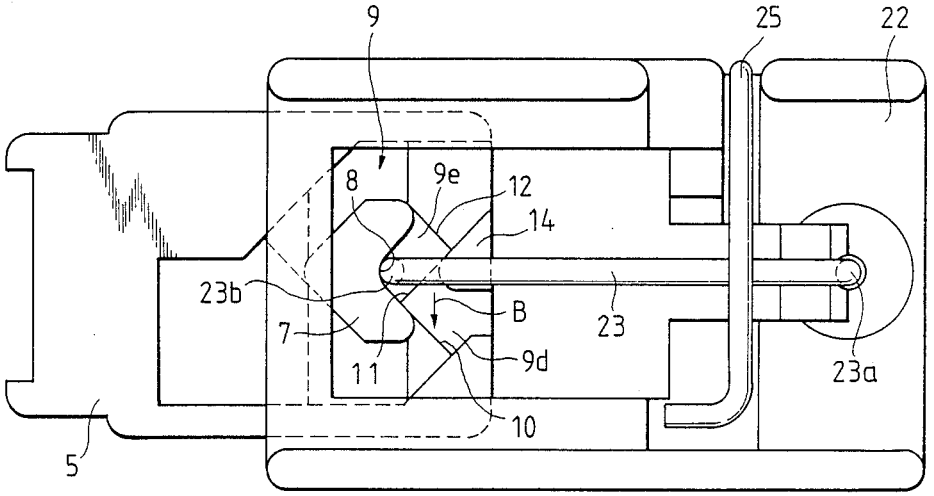
FIG. 7 is a top plan view of a portion of an embodiment of the switch device of the present invention in the operative position and FIG. 8 is a cross-sectional view of another embodiment of the switch device of the present invention in the operative position.

Thereafter, to return the operating member 15, the operating member 15 is released from the depressed position thus allowing the return spring 21 to exert force in the direction of arrow A As a result, the distal end 23*b* of the lock pin 23 is guided by the convex guide portion 14 as indicated by an arrow D (FIG. 4). Specifically, the distal end 23*b* moves from the fourth surface 9*d* to the fifth surface 9*e* via the stepped portion 11. As shown in FIG. 7, at the fifth surface 9*e* the distal end 23*b* is locked in engagement with retaining portion 8 of the cam groove 9. The holder spring 25 applies a force on the lock pin 23 to urge the distal end 23*b* in the direction of arrow B. That is, the distal end 23*b* is biased into engagement with the retaining portion 8. Therefore, the distal end 23*b* of the lock pin 23 can successfully engage the retaining portion 8 of the cam groove 9 to hold the operating member 15 in the operative position. In the operative position, the movable electrical contact 19 is kept in contact with the stationary electrical contacts 3 to maintain the switch 20 in the closed or activated condition to energize an associated load and to light the lamp 4.

When the operating member 15 is again depressed, the distal end 23*b* of the lock pin 23 moves from the fifth surface 9*e* to the sixth surface 9*f* of the cam groove 9 via the stepped portion 12. This path is represented by arrow E depicted in FIG. 5. At this point, the engagement of the distal end 23*b* and the retaining portion 8 is released.

Specifically, if the operating member 15 is released from the depressed state, the operating member 15 returns to the initial or inoperative position. This movement is achieved under the influence of the return spring 21. Consequently, the movable electrical contact 19 moves a distance from the stationary electrical contacts 3 thereby de-energizing the associated load and the lamp 4. At this time, the distal end 23*b* of the lock pin 23 moves from the sixth surface 9*f* to the first surface 9*a* via the seventh and eighth surfaces 9*g* and 9*h* and the stepped portion 13. This sequential movement is shown by arrow F depicted in FIG. 4.

The lock pin 23, that cooperates with the cam groove 9 to provide the lock means, is not in the form of a torsion coil spring but is formed of a generally U-shaped wire. This structure allows for the manufacture of a compact lock means. Moreover, since the distal end 23*b* of the lock pin 23 is urged by the holder spring 25 in the direction of arrow B, the retaining portion 8 of the cam groove 9 positively engages the distal end 23*b* of the lock pin 23 upon movement of the distal end 23*b* from the fourth surface 9*d* to the fifth surface 9*e*. Without the biasing force exerted on the distal end 23*b* of the lock pin 23 in the direction of the arrow B the distal end 23*b* would not necessarily successfully be guided by the convex guide portion 14. In fact, the success of such would depend on the manner of manipulation of the operating member 15. If the distal end 23*b* was not adequately guided by the convex guide portion 14 it could possibly be moved from the fourth surface 9*d* directly to the sixth surface 9*f* and skip over the stepped portion 11 and the fifth surface 9*e*.

Indeed, this particular problem has been encountered with the conventional switch device structures. This embodiment of the present invention overcomes the aforementioned difficulty by providing a switch structural design producing an urging force on the distal end 23*b* of the lock pin 23 in the direction of the arrow B. As a result, the lock pin 23 positively engages the retaining portion 8 of the cam groove 9. More precisely, in the present invention the holder spring 25 urges both the distal end 23*b* of the lock pin 23 into the cam groove 9 and the distal end 23*b* toward the retaining portion 8 of the cam groove 9 when the distal end 23*b* is situated between the retaining portion 8 and the convex guide portion 14. That is, when the distal end 23*b* is disposed in an area where the convex guide portion 14 cannot guide the distal end 23*b* toward the retaining portion 8, the lock pin 23 is pushed to engage the retaining portion 8.

Figure 8:
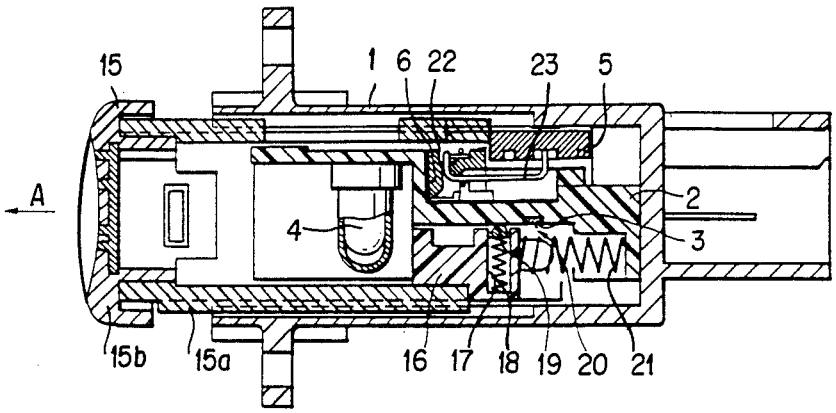

In the above described embodiment of the present invention, the cam groove 9 is provided on the lock plate 5 mounted on the casing 1. The lock pin holder 22 connects the lock pin 23 to the operating member 15. Alternatively, it is possible to mount the cam means including a cam groove on the operating member 15 and lock pin on the casing as shown in FIG. 8.

Other embodiments of the present invention will be apparent to those skilled in the art from consideration of the specification and practice of the disclosed invention. It is intended that the specification and examples be considered as exemplary only, with the true scope and spirit of the invention being represented by the following claims.

What is claimed is:

1. A compact switch device comprising:

a casing having an interior, a first open end, and a second end;

an operating member depressibly mounted on the casing for movement within the interior of the casing between a first position and a second position;

a return spring cooperating with the operating member to bias the operating member in the first position;

a cam means mounted on the casing, the cam means having a cam groove with a closed loop configuration, a retaining portion a generally V-shape and a convex guide potion spaced a distance from and opposite to the retaining portion;

a lock pin having first and second ends, the second end being pivotably mounted in the operating member, the first end being received in the cam groove for guided movement responsive to depression of the operating member, the first end being fixedly engageable in the retaining portion to secure the operating member in the second position, and the first end being displaceably guided by the convex guide portion toward the retaining portion, the lock pin including a wire bent in a generally U-shape and including a straight portion intermediate the first and second ends, the lock pin being angularly movable about the second end thereof to permit the first end of the lock pin to ride along the cam groove;

a holder spring for biasing the first end of the lock pin to ride in the cam groove and to move the first end of the lock pin toward the retaining portion when the first end of the lock pin is situated between the retaining portion and the convex guide portion, the holder spring including a wire formed of a generally U-shape defined by two legs and one of the two legs of the holder spring being resiliently held against the straight portion of the lock pin; and a switching means mounted on the casing to be opened and closed selectively in response to the depressible movement of the operating member.

2. A compact switch device comprising:

a casing having an interior , a first open end, and a second end,;

an operating member depressibly mounted on the casing for movement within the interior of the casing between a first position and a second position;

a return spring cooperating with the operating member to bias the operating member in the first position;

a cam means mounted on the operating member, the cam means having a cam groove with a closed loop configuration, a retaining portion of generally V-shape and a convex guide portion spaced a distance from and opposite to the retaining portion;

a lock pin having first and second ends, the second end being pivotably mounted in the casing, the first end being received in the cam groove for guided movement responsive to depression of the operating member, the first end being fixedly engageable in the retaining portion to secure the operating member in the second position, and the first end being displaceably guided by the convex guide portion toward the retaining portion, the lock pin including a wire bent in a generally U-shape and including a straight portion intermediate the first and second ends, the lock pin being angularly movable about the second end thereof to permit the first end of the lock pin to rid along the cam groove;

a holder spring for biasing the first end of the lock pin to ride in the cam groove and to move the first end of the lock pin toward the retaining portion when the first end of the lock pin is situated between the retaining portion and the convex guide portion, the holder spring including a wire formed of a generally U-shape defined by two legs and one of the two legs of the holder spring being resiliently held against the straight portion of the lock pin; and a switching means mounted on the casing to be opened and closed selectively in response to the depressible movement of the operating member.

3. A compact switch device comprising:

a casing having an interior, a first open end, and a second end;

an operating member depressibly mounted on the casing for movement within the interior of the casing between a first position and a second position;

a return spring cooperating with the operating member to bias the operating member in the first position;

a cam means mounted on the casing, the cam means having a cam groove with a closed loop configuration, a retaining portion of a generally V-shape and a convex guide portion spaced a distance from and opposite to the retaining portion;

a lock pin having first and second ends, the second ned being pivotably mounted on a lock pin holder fixed of the operating member, the first end being received in the cam groove for guided movement responsive to depression of the operating member, the first end being fixedly engageable in the retaining portion to secure the operating member in the second position, and the first end being displaceably guided by the convex guide portion toward the retaining portion, the lock pin including a wire bent in a generally U-shape and including a straight portion intermediate the first and second ends, the lock pin being angularly movable about the second end thereof to permit the first end of the lock pin to ride along the cam groove;

a holder spring for biasing the first end of the lock pin to ride in the cam groove and to move the first end of the lock pin toward the retaining portion when the first end of the lock pin is situated between the retaining portion and the convex guide portion, the holder spring including a wire formed of a generally U-shape defined by two legs and one of the two legs of the holder spring being resiliently held against the straight portion of the lock pin, the holder spring being fitted to the lock pin holder; and a switching means mounted on the casing to be opened and closed selectively in response to the depressible movement of the operating member.

4. A compact switch device comprising:

a casing having an interior, a first open end, and a second end;

an operating member depressibly mounted on the casing for movement within the interior of the casing between a first position and a second position;

a return spring cooperating with the operating member to bias the operating member in the first position;

a cam means mounted on the operating member, the cam means having a cam groove with a closed loop configuration, a retaining portion of a generally V-shape and a convex guide portions paced a distance from and opposite to the retaining portion;

a lock pin having first and second ends, the second end being pivotably mounted on a lock pin holder fixed to the casing, the first end being received in the cam groove for guided movement responsive to depression of the operating member, the first end being fixedly engageable in the retaining portion to secure the operating member in the second position, and the first end being displaceably guided by the convex guide portion toward the retaining portion, the lock pin including a wire bent in a generally U-shape and including a straight portion intermediate the first and second ends, the lock pin being angularly movable about the second end thereof to permit the first end of the lock pin to ride along the cam groove;

a holder spring for biasing the first end of the lock pin to ride in the cam groove and to move the first end of the lock pin toward the retaining portion when the first end of the lock pin is situated between the retaining portion and the convex guide portion, the holder spring including a wire formed of a generally U-shape defined by two legs and one of the two legs of the holder spring being resiliently held against the straight portion of the lock pin, the holder spring being fitted to the lock pin holder; and a switching means mounted on the casing to be opened and closed selectively in response to the depressible movement of the operating member.

* * * * *

UNITED STATES PATENT AND TRADEMARK OFFICE

CERTIFICATE OF CORRECTION

PATENT NO. : 4,956,529

DATED : September 11, 1990

INVENTOR(S) : Hiroshi Ueno

It is certified that error appears in the above-identified patent and that said Letters Patent is hereby corrected as shown below:

Claim 4, Column 8, Line 14, change "portions" to --portion-- and change "paced" to --spaced--.

Signed and Sealed this

First Day of September, 1992

*Attest:*

DOUGLAS B. COMER

*Attesting Officer*

*Acting Commissioner of Patents and Trademarks*